US012631010B2

(12) United States Patent
Bawey et al.

(10) Patent No.: US 12,631,010 B2
(45) Date of Patent: May 19, 2026

(54) METHOD FOR OPERATING A CIRCULATION SYSTEM, AND CIRCULATION SYSTEM

(71) Applicant: LTZ—ZENTRUM FÜR LUFT—UND TRINKWASSERHYGIENE GMBH, Berlin (DE)

(72) Inventors: Roberto Bawey, Berlin (DE); Patric Opitz, Berlin (DE); Olaf Heinecke, Berlin (DE)

(73) Assignee: LTZ—ZENTRUM FÜR LUFT—UND TRINKWASSERHYGIENE GMBH, Berlin (DE)

( * ) Notice: Subject to any disclaimer, the term of this patent is extended or adjusted under 35 U.S.C. 154(b) by 71 days.

(21) Appl. No.: 18/820,895

(22) Filed: Aug. 30, 2024

(65) Prior Publication Data

US 2024/0426085 A1 Dec. 26, 2024

Related U.S. Application Data

(63) Continuation of application No. 18/064,455, filed on Dec. 12, 2022, now Pat. No. 12,077,949, which is a continuation of application No. 17/055,344, filed as application No. PCT/EP2019/062547 on May 15, 2019, now Pat. No. 11,525,247.

(30) Foreign Application Priority Data

May 15, 2018 (DE) ..... 102018111579.2

(51) Int. Cl.

| | |
|---|---|
| ***E03B 7/04*** | (2006.01) |
| ***F24D 17/00*** | (2022.01) |
| ***F24D 19/10*** | (2006.01) |

(52) U.S. Cl.

CPC ..... *E03B 7/04* (2013.01); *F24D 17/0078* (2013.01); *F24D 19/1054* (2013.01); *F24D 17/0073* (2013.01)

(58) Field of Classification Search

CPC ..... E03B 7/04; E03B 7/045; F24D 17/0073

See application file for complete search history.

(56) References Cited

U.S. PATENT DOCUMENTS

| | | | |
|---|---|---|---|
| 11,525,247 | B2 | 12/2022 | Bawey |
| 2009/0020172 | A1 | 1/2009 | Walker |
| 2012/0204981 | A1 | 8/2012 | Goerdt et al. |
| 2012/0211085 | A1 | 8/2012 | Abbing |

(Continued)

FOREIGN PATENT DOCUMENTS

| | | | |
|---|---|---|---|
| DE | 102014013464 | A1 | 3/2016 |
| DE | 202015007277 | U1 | 1/2017 |
| DE | 102017101532 | A1 | 7/2018 |

(Continued)

OTHER PUBLICATIONS

ISA/EP, International Search Report for corresponding PCT Patent Application No. PCT/EP2019/062547, mailed Sep. 20, 2019, 2 pages.

(Continued)

*Primary Examiner* — Paul J Gray

(74) *Attorney, Agent, or Firm* — NK Patent Law

(57) ABSTRACT

The invention relates to a method for operating a circulation system comprising a cooling device with an input port and an output port for cooling water. The invention also relates to a circulation system for implementing said method.

8 Claims, 8 Drawing Sheets

(56) References Cited

U.S. PATENT DOCUMENTS

| | | | |
|---|---|---|---|
| 2015/0354849 | A1 | 12/2015 | Matsuo |
| 2018/0135870 | A1 | 5/2018 | Theile et al. |

FOREIGN PATENT DOCUMENTS

| | | | |
|---|---|---|---|
| EP | 1626034 | A1 | 2/2006 |
| EP | 3159457 | A1 | 4/2017 |
| JP | 2005076960 | A | 3/2005 |

OTHER PUBLICATIONS

USPTO; Non-Final Action for U.S. Appl. No. 17/055,344 dated Nov. 16, 2021, 15 pages.
USPTO, Non-Final Office Action for U.S. Appl. No. 17/611,291, dated Feb. 7, 2024, 22 pages.

METHOD FOR OPERATING A CIRCULATION SYSTEM, AND CIRCULATION SYSTEM

This application is a continuation application of U.S. patent application Ser. No. 18/064,455 filed on Dec. 12, 2022, being issued as U.S. Pat. No. 12,077,949 on Sep. 3, 2024, which is a continuation application of U.S. patent application Ser. No. 17/055,344 filed on Nov. 13, 2020, now U.S. Pat. No. 11,525,247 issued on Dec. 13, 2022, which is a U.S. National Stage Application of International Patent Application No. PCT/EP2019/062547 filed on May 15, 2019, which claims priority to German Patent Application No. 10 2018 111 579.2 filed on May 15, 2018, the entire content of all of which is incorporated by reference herein.

The invention relates to a method for operating a circulation system, as well as the circulation system, each time according to the features of the preambles of the independent claims.

In order to prevent microbial growth in cold water networks, DIN EN 806 as well as VDI Guideline 6023 require for potable water installations in buildings a limiting of the temperature of the cold potable water (PWC) in all lines of the installations at all times to a value of not more than +25° C. According to DIN EN 806-2,3.6, the water temperature for cold water locations should not go beyond +25° C. within 30 seconds of the full opening of a tapping point. Moreover, in order to prevent a stagnation of the water, the cold water installation should be designed so that, under normal operating conditions, the potable water is regularly replenished in all lines of the installation. Similarly, the VDI Guideline 6023 also contains the recommendation of holding the temperature of the potable water as much as possible below +25° C. Naturally, a limiting of the temperature of water is often also seen as necessary for other water installations, such as installations for industrial process water.

The occurrence of high PWC temperatures is favored by the solitary or combined occurrence of various circumstances, including:

- high PWC temperatures already at the household junction,
- thermal influencing of the regions of the installation, for example by the position and orientation of the building or the regions of the installation within the building,
- inadequate insulation of the PWC pipelines to keep out heat,
- installation of PWC pipelines in rooms and equipment spaces with heat sources, in common installation areas such as shafts, ducts, suspended ceilings and installation walls with heat-producing media (such as heating system pipelines, potable hot water (PWH) and potable hot water circulation systems (PWH-C), air intake and air exhaust ducts, lamps),
- phases of the stagnation in the aforesaid installation regions,
- highly branching PWC installations with concomitant large installation volumes,
- overly large dimensioned PWC pipelines.

The method of preference in the effort to meet the mandated rules in stagnation phases is thus far the forced flushing of the installations in order to simulate the desired operation in these phases.

In order to provide cold potable water, various cooled circulation systems have already been proposed for the cold water network.

A cooled circulation system is already known from EP 1 626 034 A1, in which a controlled adding of a disinfectant to the water is proposed.

From DE 10 2014 013 464 A1 there is known a method for the operating of a circulation system with a heat storage, a circulation pump, a regulating unit, and at least two branches, and having an otherwise unknown pipe network structure. The branches, each possessing a valve adjustable by a driving motor, are matched up with temperature sensors, which are situated upstream from each mixing point between the branches. The driving motors and/or the circulation pump are connected for the data exchange to the regulating unit in wireless or wired manner. The regulating unit is designed to carry out a thermal and hydraulic balancing and a thermal disinfecting by limiting the range of metered temperatures and/or by adapting the pump power in dependence on a difference between an actual temperature value and a target temperature value.

From DE 20 2015 007 277 U1 there is known a potable water and service water supply arrangement of a building having a household junction for cold water, which is connected to the public supply network. The supply arrangement comprises at least one circulation conduit, which is provided with a pump and which leads to at least one consumer. A heat exchanger, extracting heat from the water, is provided in the circulation conduit.

Moreover, there is described in EP 3 159 457 A1 a potable water and service water supply arrangement of the kind known from DE 20 2015 007 277 U1, wherein the heat exchanger is formed by a latent heat storage and comprises a motorized flushing valve provided in the circulation conduit, being connected to a control device for control purposes. The flushing valve is arranged between the latent heat storage and the point where the household junction enters the circulation conduit, being situated downstream from the latent heat storage in the flow direction.

The known circulation systems with cooling of the water do not assure, or do not effectively assure, that the water temperature remains below the desired temperature for all partial sections and for all times during the operation of the circulation system.

The problem which the present invention proposes to solve is therefore to ensure in effective manner that the water temperature remains below the desired temperature for all partial sections and for all times during the operation of a circulation system.

The problem is solved according to the invention with the features of the independent patent claims.

The method according to the invention relates to a circulation system having a cooling device with an input port and an output port for the cooling of water and having a pipeline system with multiple branches comprising one or more partial sections with given thermal coupling to the surroundings and being connected by means of nodes, wherein one or more of the lines of the pipeline system are configured as a flow pipe, at least one as a single supply line connected to a tapping point, and at least one line configured as a circulation conduit connected to the flow pipe or pipes.

The method according to the invention for operating the circulation system is characterized in that a temperature change of the water between the initial region and the end region is determined according to a model of the axial temperature change for the first partial section connected to the output port, starting from a temperature start value $T_{MA}^{*}<T_{soll}$ and a volume flow start value $V_z^{*}$, a temperature change of the water between the initial region and the end region is determined for each further given partial section connected to the first partial section according to the model of the temperature change, under the boundary condition that the water temperature in the initial region of the given partial section is equal to the water temperature in the end region of the partial section to which the given partial section is connected in the flow direction of the water, and the value $T_a$ of the water temperature and the value $V_z$ of the volume flow at the output port are chosen such that, in the end region of each partial section of the circulation system, the water temperature is $T_{ME}<T_{soll}$ and at the input port the water temperature is set at $T_b<T_{soll}$ with $T_{soll}-T_b<\theta$, where $\theta>0$ is a given value.

Preferably, the determining consists in a calculating, according to the model, of the axial temperature change of the water between the initial region and the end region of the partial section, i.e., the corresponding piece of conduit, based on heat uptake from the surroundings of the partial section. Thus, beginning with the first partial section connected to the cooling device, one moves successively through the entire system of partial sections and therefore calculates the temperature in the overall system.

According to the invention, the value $T_a$ of the water temperature and the value $V_z$ of the volume flow at the output port for which the water temperature is $T_{ME}<T_{soll}$ in the end region of each partial section of the circulation system and the water temperature $T_b<T_{soll}$ at the input port is $T_{soll}-T_b<\theta$, where $\theta>0$ is a given value, are determined in the method by means of a modeling of temperature and volume flows of the circulating water in the conduit system, preferably by a calculation. This is done preferably for a state with steady Vz.

The cooling device and possibly a circulation pump of the circulation system are then adjusted so that the water temperature and the volume flow take on the ascertained values of $T_a$ and the value of $V_z$.

It is proposed according to the invention that a temperature is set at an output port, and temperature changes are calculated based on this and used for the modeling according to the characterizing passage of claim 1.

The advantage of a calculation is that no sensor is needed to measure anything, and one can evaluate and vary factors of influence and possibly also make predictions.

Calculation offers the advantage over a two-point regulating system and/or a cascade control of building floors or a control by pipeline branches that fewer metering points are required and the system as a whole is less prone to oscillations.

Thus, the regulation according to the invention, as opposed to the prior art, is accomplished by means of a setpoint operation at the output port, although the design of the regulator is based on the overall water conduit system with distributed parameters and a calculation of multiple temperatures TME. Hence, basically only one regulator and only one temperature setting are required to provide the temperature Ta.

A similar problem to that of a cold water network exists in the case of a hot water network. Only the operating temperatures are changed, and in place of a cooling device one employs a heater or a reservoir. The temperatures in the hot water network are between 60° C. at the reservoir outlet and 55° C. at the reservoir inlet. Unlike the cold water network, where a temperature rise occurs on account of heat input from the surroundings, heat losses result in a temperature drop in the hot water network.

The following formula holds for both the temperature drop in a hot water network and the temperature rise in a cold water network.

$$\Delta\vartheta = \dot{q}\frac{l}{\dot{m}\cdot c_w} = \dot{q}\frac{l}{\dot{V}\cdot p\cdot c_w}$$

$\dot{q}$ = specific heat flux in W/m $\Delta\vartheta = \vartheta_{medium\ start} - \vartheta_{medium\ end}$ hot water $\Delta\vartheta = \vartheta_{medium\ end} - \vartheta_{medium\ start}$ cold water The invention therefore also encompasses the similar instance of a hot water network, where a reservoir or heater is used in place of a cooling device.

Moreover, the above given formulas also hold in a cold water network if the temperature of the water is higher than the ambient temperature.

In general, therefore, the invention encompasses, with corresponding adaptations of the formulas used for the calculation according to the model, the case of using a heat exchanger in place of a cooling device, which can heat or cool the water.

The term branch signifies a line consisting of a partial section or multiple partial sections between two nodes, with no further nodes lying between them. The branches are connected across nodes.

Preferably, the boundary condition that the water temperature in the initial region of the given partial section is equal to the water temperature in the end region of the partial section to which the given partial section is connected pertains only to the partial sections of a respective branch.

The temperature and the magnitude of the volume flow emerging from one node into an adjacent partial section depends on the temperatures and magnitudes of the incoming volume flows. The invention preferably assumes these to be given by the design of the pipeline system.

The apportionment of the volume flows exiting from a node among the different outgoing lines or partial sections is preferably assumed by the invention as being given by the design of the pipeline system.

Preferably, mix temperatures when branches join together and the temperatures when branches are divided are calculated based on a percentage volume flow apportionment.

In the method according to the invention, the pipeline system is assumed as given, it being understood that the pipeline system is designed in accordance with the rules of DIN 1988-300 for the design of pipe networks, specifying in particular certain nominal widths of the PWC (Potable Water Cold) lines and values for the thermal coupling of the circulating water to the surroundings. It is understood that the designs of the pipe network specified or recommended in other countries or regions can also be generally heeded.

Preferably, the highest permissible value according to the design of the pipeline system is chosen as the volume flow start value $V_z$*. This value is decreased until such time as the temperature of the circulating water is close to $T_{soll}$, since with diminishing volume flow the temperature of the circulating water increases and therefore the temperature at the input port increases.

Preferably, the value $T_{MA}$* is varied and the highest value $T_a$ of the water temperature is chosen for which the water temperature at the input port is $T_b<T_{soll}$ with $T_{soll}-T_b<\theta$, where $\theta>0$ is a predetermined value.

Given $T_{soll}-T_b<\theta$, it is ensured that the water temperature in the circulation system is not set too cold and the system is not operated in an energy ineffective manner. Typically, $\theta$ lies in a range between 1° C. and 5° C., but it may also lie in another range.

The determination of the temperature change of the water between the initial and end region of each partial section can be done according to models which are known in themselves, for example by simulation calculations or also appropriate known formulas.

When implementing the method according to the invention, the circulation system is preferably operated in a state in which no water removal and no water uptake occurs, because in this state a greater heating of the water may be expected than in a state in which a water removal occurs, and therefore a safety margin from a state with undesirably high water temperature is assured by using the parameters $T_a$ and $V_z$ as determined by the method.

The parameters $T_a$ and $V_z$ as determined by the method are used advantageously to model a given circulation system, in which the pipeline system is designed in accordance with the legal specifications regarding nominal widths and thermal coupling of the circulating water to the surroundings, and to operate it such that the mandated rules regarding the temperature of the potable water in the circulation system are fulfilled.

Simulations of the applicant for already existing systems have revealed that, by using the parameters set according to the invention: a) the mentioned legal requirements are fulfilled, and b) a greater energy efficiency of the system operation is achieved.

The parameters $T_a$ and $V_z$ as determined by the method are used advantageously in order to determine the design of the cooling device in terms of its cooling power in a given circulation system, in which the pipeline system is designed in accordance with the legal specifications regarding nominal widths and thermal coupling of the circulating water to the surroundings. Moreover, the design of a circulation pump may be determined in regard to its pumping power.

The following terms shall be used in this text with a specific meaning, the definition relying on the standard DIN EN 806.

The circulation conduit of the circulation system denotes a conduit downstream from a tapping point in the circulation, in which water runs from the output port of a cooling device back to the input port of the cooling device, if no further tapping point is connected to this conduit.

The term node is used for a conduit element to which conduits are connected. Either at least two volume flows may enter a node and exactly one volume flow depart from it, or exactly one volume flow may enter and at least two volume flows may depart from it. A node corresponds to a branching point.

Preferably, exactly two volume flows enter a node of the circulation system and one volume flow departs from it, or exactly one volume flow enters and exactly two volume flows depart from it, for example, in the manner of a T-piece.

Kirchhoff's first law applies to the nodes of the circulation system, by analogy with electrical circuits, whereby the sum of the incoming volume flows is equal to the sum of the outgoing volume flows.

Preferably, the outgoing volume flows at each node point are apportioned in departing volume flows of equal size. It is to be understood that other apportionments are also possible.

For a node with exactly one departing volume flow with different temperatures and exactly one entering volume flow it is preferably assumed that the temperature $t_m$ and the mass flow $m_m$ of the mix water of the departing volume flow are related by the following equation to the temperature tk and mass flow mk of the colder flow or the temperature tw and mass flow mw of the warmer flow:

$$t_m = \frac{t_k * m_k + t_w * m_w}{m_m}$$

$t_m$=Temperature of mix water (° C.)

$t_k$=Temperature of colder water (° C.)

$t_w$=Temperature of warmer water (° C.)

$M_m$=Mass/volume (flow) of mix water (kg; $m^3$; kg/h; $m^3$/h or %)

$m_x$=Mass/volume (flow) of cold water (kg; $m^3$; kg/h; $m^3$/h or %)

$m_w$=Mass/volume (flow) of warm water (kg; $m^3$; kg/h; $m^3$/h or %)

For the determination of the temperature change of the water between the initial and end region of a partial section, the following parameters can be used preferably, along with the length of the partial section $T_{Luft}$=the temperature of the ambient air (° C.)

$K_R$=the heat transfer coefficient of the pipeline (W/(m*K))

$m_M$=the mass flow of the water in the partial section (kg/s)

$c_{p,m}$=the spec. heat capacity of the water (J/(kg*K)

$V_M$=the volume flow of the water in the partial section ($m^3$/s)

$P_M$=the density of the water (kg/$m^3$)

Advantageously, a temperature change of the water between the initial region and the end region can be determined for each partial section of the circulation system during a stationary volume flow, wherein the water temperature in the end region of a given partial section is chosen equal to the water temperature in the initial region of the partial section to which the given partial section is connected in the flow direction of the circulating water. Therefore, for each partial section of the circulation system it is possible to determine the temperature of the water in the end region of the respective partial section by starting from the temperature in the initial region.

Advantageously, starting from a temperature at the output port during a stationary volume flow it is possible to determine the temperature of the circulating water for each partial section, i.e., it is also possible to determine a value $T_a$ of the water temperature at the output port as the initial temperature of the partial section adjacent to the output port such that the water temperature is $T_{ME}<T_{soll}$ for the end regions of all partial sections.

In a further embodiment of the invention it is proposed that the values $T_a$ and $V_z$ are determined in an iterative approximation procedure, wherein the water temperature $T_{ME}$ in the end region is calculated for each given partial section, starting from a temperature start value $T_{MA}^*<T_{soll}$ and a volume flow start value $V_z^*$ for the first partial section connected to the output port, the water temperature $T_{MA}'$ in the initial region of the next connected partial section being chosen equal to the water temperature $T_{ME}$ in the end region of the given partial section.

In a further embodiment of the invention it is proposed that the partial sections are designed axially uniformly in regard to their thermal coupling to the surroundings along the length between their initial region and their end region, i.e., they do not change axially. This enables a simplification of the computations.

In a further embodiment of the invention it is proposed that the water temperature $T_{ME}$ in the end region of at least one partial section with length L is determined by means of the formula $$T_{ME} = (T_{MA} - T_{Luft}) * e^{-\varepsilon * L} + T_{Luft}$$

$$\varepsilon = \frac{k_R}{m_M * c_{pm}} = \frac{k_R}{V_M * P_M * C_{pm}}$$

where

L=the length (m) of the uniform partial section ($T_{S1}$)

$T_{MA}$=the water temperature in the initial region (° C.)

$T_{ME}$=the water temperature in the end region (° C.)

$T_{Luft}$=the temperature of the ambient air (° C.)

$K_R$=the heat transfer coefficient of the pipeline (W/(m*K))

$m_M$=the mass flow of the water in the partial section (kg/s)

$c_{p,m}$=the spec. heat capacity of the water (J/(kg*K)

$V_M$=the volume flow of the water in the partial section ($m^3$/s)

$P_M$=the density of the water (kg/$m^3$)

This formula allows a good approximation of the temperature change for uniform partial sections.

In another embodiment of the invention, it is proposed that the heat transfer coefficient of the partial sections is determined by the formula $$\frac{1}{k_R} = \frac{1}{d_i * \alpha_i * \pi} + \frac{1}{\Lambda_R} + \frac{1}{d_a * \alpha_a * \pi}$$

where $1/K_R$=the heat transmission resistance of the pipeline (m*K/W)

αi=the inward heat transfer coefficient (W/($m^2$*K))

1/ΛR=the thermal resistance (m*K/W)

$a_a$=the outward heat transfer coefficient (W/($m^2$*K))

$d_a$=the outer diameter (m)

$d_i$=the inner diameter (m)

and $$\frac{1}{\Lambda_R} = \frac{1}{2 * \pi} * \left(\frac{1}{\lambda_r} * \ln\frac{d_{aR}}{d_{iR}} + \frac{1}{\lambda_D} * \ln\frac{d_{aD}}{d_{iD}}\right)$$

In the following, equations 1-4 shall be used to determine the temperature changes and the heat gain in the water due to the temperature difference from the surroundings.

For this, equation 1 for the thermal resistance is inserted into equation 2 and thus the heat transition resistance is found. The heat transfer coefficient, equation 3, is calculated using the reciprocal of equation 2.

Thermal resistance $1/\lambda_{ges}$ of a pipeline incl. insulation $$\frac{1}{\lambda_{ges}} = \frac{1}{2 \cdot \pi} \cdot \left(\frac{1}{\lambda_R} \cdot \ln\frac{d_{aR}}{d_{iR}} + \frac{1}{\lambda_D} \cdot \ln\frac{d_{aD}}{d_{iD}}\right), \quad \text{Equation 1}$$

see *VDI* 2055, 2008

Heat transition resistance: $1/U_R$ of the insulated pipeline $$\frac{1}{U_R} = \frac{1}{d_{iR} \cdot a_i \cdot \pi} + \frac{1}{\lambda_{ges}} + \frac{1}{d_{aD} \cdot a_a \cdot \pi} \quad \text{Equation 2}$$

$$\frac{1}{U_R} = \frac{1}{2 \cdot \pi} \cdot \left(\frac{1}{\lambda_R} \cdot \ln\frac{d_{aR}}{d_{iR}} + \frac{1}{\lambda_D} \cdot \ln\frac{d_{aD}}{d_{iD}}\right) + \frac{1}{d_{aD} \cdot a_a \cdot \pi},$$

see *VDI* 2055, 2008

Heat transfer coefficient $U_R$ of the insulated pipeline $$U_R = \frac{\pi}{\frac{1}{2} \cdot \left(\frac{1}{\lambda_R} \cdot \ln\frac{d_{aR}}{d_{iR}} + \frac{1}{\lambda_D} \cdot \ln\frac{d_{aD}}{d_{iD}}\right) + \frac{1}{d_{aD} \cdot a_a}} \quad \text{Equation 3}$$

The heat transfer coefficient is the central component of equation 4 for calculating a temperature at the end of a partial section.

With the aid of equation 4, the respective starting and end temperatures of the cold water are found for all relevant partial sections. The deriving of the formula for the axial heating of water in a pipeline starts with equation 5:

$$\vartheta_{ME} = \Delta\vartheta_a \cdot e^{\frac{-U_R \cdot l}{m \cdot c_W}} + \vartheta_{Luft} \quad \text{Equation 4}$$

$$\Delta\vartheta = \Delta\vartheta_a\left(1 - e^{\frac{-U_R \cdot l}{m \cdot c_W}}\right), \quad \text{Equation 5}$$

see *VDI* 2055, 2008

$$\Delta\vartheta = \vartheta_{MA} - \vartheta_{ME}$$

$$\vartheta_{MA} - \vartheta_{ME} = \Delta\vartheta_a\left(1 - e^{\frac{-U_R \cdot l}{m \cdot c_W}}\right)$$

$$\vartheta_{ME} = -\Delta\vartheta_a\left(1 - e^{\frac{-U_R \cdot l}{m \cdot c_W}}\right) + \vartheta_{MA}$$

$$\vartheta_{ME} = -\Delta\vartheta_a + \Delta\vartheta_a\, e^{\frac{-U_R \cdot l}{m \cdot c_W}} + \vartheta_{MA}$$

insert $\Delta\vartheta_a = \vartheta_{MA} - \vartheta_{Luft}$ and then combine.

$$\vartheta_{ME} = \Delta\vartheta_a\, e^{\frac{-U_R \cdot l}{m \cdot c_W}} + \vartheta_{Luft}$$

In an iterative calculation with incremental/stepwise increasing of the volume flow, one seeks that volume flow which operates the cold water installation with a desired/given spread of 5 K (15° C./20° C.), for example.

With the aid of this solution, it is possible to determine not only a volume flow of the circulation system, which is the primary consideration, but also a water temperature for any given point in the particular pipeline network.

Preferably, the iterative approximation method is the known Excel target value search; see Excel and VBA: an introduction with practical applications in the natural sciences, by Franz Josef Mehr, María Teresa Mehr, Wiesbaden 2015, section 8.1.

According to the invention, key data of the pipeline system including the above indicated parameters of the partial sections are entered into the program and the target value search is used to determine the volume flow $V_z$ for which the potable water target temperature $T_b$ is achieved; for example, as follows 3.1.1 Material values, water

| No. MT | Designation | Value/units |
|---|---|---|
| MT1 | Potable water input temperature after output port | 15.0° C. |
| MT2 | Target potable water temperature | 20.0° C. |
| MT3 | Density of water at 17.5° C. | 998.8 kg/m$^3$ |
| MT4 | Volume flow $V_z$ | 0.022 m$^3$/h |
| MT5 | Specific heat capacity | 1.163 Wh/(Kg*K) |

3.1.2 Heat transmission coefficients

| No. W | Designation | | (W/(m$^2$*K)) |
|---|---|---|---|
| Wi | Heat transmission coefficients outward | $\alpha_a$ | 5 |
| Wa | Heat transmission coefficients inward | $\alpha_i$ | 0 |

3.1.3 Ambient temperatures

| No. UT | Designation | Temperature $t_{Luft}$ in ° C. |
|---|---|---|
| UT1 | Boiler room | 30° C. |
| UT2 | Basement corridor | 20° C. |
| UT3 | Shaft | 30° C. |
| UT4 | Hallway suspended ceiling | 33° C. |
| UT5 | Bathroom front wall | 26° C. |
| UT6 | Return shaft | 26° C. |

3.1.4 Insulation

| No. DA | Designation | Material | Thermal conductivity coefficient $\lambda_{DA}$ in W/(m*K) |
|---|---|---|---|
| DA1 | Rockwool with PVC | Boiler room | 0.035 |
| DA2 | Rockwool aluminum lined | Basement corridor | 0.035 |
| DA3 | Rockwool aluminum lined | Riser | 0.035 |
| DA4 | Rockwool aluminum lined | Hallway ceiling | 0.035 |
| DA5 | Flex EL-Conel 24 × 18 | Bathroom front wall | 0.032 |
| DA6 | with 9 mm insulation in the floor | Bathroom floor | 0.04 |

3.1.5 Pipe materials

| No. DA | Designation | Nominal width mm | Wall thickness mm | Thermal conductivity coefficient $\lambda_R$ in W/(m*K) |
|---|---|---|---|---|
| R1 | Viega Raxofix | 16 × 2.2 | 2.2 | 0.4 |
| R2 | Viega Raxofix | 20 × 2.8 | 2.8 | 0.4 |
| R3 | Viega Raxofix | 25 × 2.7 | 2.7 | 0.4 |
| R4 | Viega Raxofix | 32 × 3.2 | 3.2 | 0.4 |
| R5 | Viega Raxofix with insulation | 16 × 2.2 | 2.2 | 0.35 |
| R6 | Viega Raxofix with insulation | 20 × 2.8 | 2.8 | 0.35 |
| R7 | Viega Raxofix with insulation | 25 × 2.7 | 2.7 | 0.35 |

-continued 3.1.5 Pipe materials

| No. DA | Designation | Nominal width mm | Wall thickness mm | Thermal conductivity coefficient $\lambda_R$ in W/(m*K) |
|---|---|---|---|---|
| R8 | Viega Raxofix with insulation | 32 × 3.2 | 3.2 | 0.35 |
| R9 | Viega Sanpress | 15 × 1.0 | 1 | 23 |
| R10 | Viega Sanpress | 18 × 1.0 | 1 | 23 |
| R11 | Viega Sanpress | 22 × 1.2 | 1.2 | 23 |
| R12 | Viega Sanpress | 28 × 1.2 | 1.2 | 23 |
| R13 | Viega Sanpress | 35 × 1.5 | 1.5 | 23 |
| R14 | Viega Sanpress | 42 × 1.5 | 1.5 | 23 |
| R15 | Viega Sanpress | 54 × 1.5 | 1.5 | 23 |
| R16 | Viega Sanpress | 64 × 2 | 2 | 23 |

In this example, the calculated volume flow $V_z$ for which a target temperature Tb of 20° is achieved for an input temperature $T_a$ of 15° C. is indicated in row MT4.

In a further embodiment of the invention it is proposed that a circulation pump is integrated in the circulation system, so that a desired volume flow can be set.

Of course, several cooling devices and/or circulation pumps can also be provided.

In the following, embodiments shall be described with pipeline structures such as are used typically for potable water installations in buildings.

A connection line is a line between a supply line and a potable water installation or the circulation system.

A consumer line is a line which takes the water from the main shutoff valve to the junctions of the tapping points and optionally to appliances. A collective feed line is a horizontal consumer line between the main shutoff valve and a riser pipe. A riser pipe (downpipe) leads from one floor to another, and the building floor lines or single supply lines branch off from it. A building floor line is the line branching off from the riser pipe (downpipe) within a building floor and the single supply lines branch off from it. A single supply line is the line leading to a tapping point.

In one embodiment of the invention it is proposed that at least one flow pipe is connected to at least one loop line.

In a further embodiment of the invention it is proposed that at least one branch of the circulation conduit departs from the at least one flow pipe.

In a further embodiment of the invention it is proposed that at least one branch of the at least one circulation conduit departs from the at least one loop line.

In a further embodiment of the invention it is proposed that the at least one flow pipe comprises at least one riser line and/or a building floor line.

In a further embodiment of the invention it is proposed that the at least one flow pipe comprises a collective feed line, which is connected by a junction to a water supply network.

In a further embodiment of the invention it is proposed that the junction is connected to at least one connection line and/or at least one consumer line.

In a further embodiment of the invention it is proposed that at least one static or dynamic flow divider is arranged in the at least one flow pipe and/or the at least one loop line, by which preferably one tapping point for water is connected. Preferably, a percentage apportionment of the volume flows of 95% at the exit and 5% passing through is accomplished.

In a further embodiment of the invention it is proposed that the cooling device for the cooling of the circulating water is used to transfer thermal energy from the circulating water to another material flow, preferably by means of a heat transfer agent, which can achieve an optimization of the cooling process by suitable choice of the other material flow, such as propane, and a lessening of the energy required for the operation of the cooling device.

In a further embodiment of the invention it is proposed that the cooling device is thermally coupled to a cold generator, preferably a heat pump, a water chiller or a cold supply network, which can likewise accomplish a lessening of the energy required for the cooling process.

In a further embodiment of the invention, it is proposed to determine a consumer characteristic of the circulation pump in dependence on the delivered volume flow of the circulation pump and to determine a consumer characteristic of the cooling device in dependence on a water temperature at the output port and to adjust a volume flow $V_z$ and a water temperature $T_a$ at the output port such that the power consumption of the circulation pump and the cooling device takes on a relative or absolute minimum value, thereby improving the energy efficiency of the method.

In a further embodiment of the invention it is advisedly proposed that a value of 20° C.+/−5° C. is chosen for the temperature $T_{soll}$ and a value of 15° C.+/−5° C. is chosen for the water temperature $T_a$ at the output port.

In a further embodiment of the invention it is proposed that at least one partial section of the pipeline system is designed as an outer circulation conduit, since outer circulation conduits are usually installed particularly in already existing circulation systems.

In a further embodiment of the invention it is proposed that at least one partial section is designed as an inliner circulation conduit, since these are often installed in newer or new circulation systems.

Further benefits will be evident from the following description of the drawings.

The drawings show exemplary embodiments in the specification. The drawing, the specification, and the claims contain many features in combination. The skilled person will also advisedly consider the features individually and combine them into further meaningful combinations.

There are shown, as an example:

FIG. 1: in schematic representation, a circulation system according to the invention FIG. 2: a further embodiment of a circulation system according to the invention FIG. 3: a further embodiment of a circulation system according to the invention, in which a further heat exchanger is provided FIG. 4: a further embodiment of a circulation system according to the invention FIG. 5: a further embodiment of a circulation system according to the invention FIG. 6: a further embodiment of a circulation system according to the invention FIG. 7: a further embodiment of a circulation system according to the invention FIG. 8: a further embodiment of a circulation system according to the invention The circulation systems represented in FIGS. 1 to 8 are merely examples, the invention not being limited to these systems. In all the systems shown, exactly two volume flows enter a node and one volume flow departs from it, or exactly one volume flow enters and exactly two volume flows depart from it, as in the case of a T-piece. However, the invention is not limited to systems with such nodes. Basically, all of the lines represented between nodes and between nodes and input port, as well as nodes and output port, may consist of one or more partial sections, as defined above.

Similar components are given the same reference numbers.

In the circulation system represented in FIG. 1, one node K1 is connected across a flow pipe 4*a* to an output port 12*b* of a cooling device 12. The cooling device 12 has connections on the refrigeration side and a refrigeration pump 13.

At the node K1 there is provided a branching point to a collective line 4, a connection line to a junction 1 at a water supply network and a consumer line 3, the latter and the connection line not being part of the circulation system. Therefore, no volume flow apportioning occurs at the node K1.

The collective feed line 4 is connected to a riser pipe 5, which empties into a node K2. The node K2 branches into a building floor line 6 and a riser pipe 5, which empties into a node K3 and at which there occurs a branching to a building floor line 6 and a riser pipe 5, [which] is connected to a building floor line 6, which empties into a node K4. The node K2 is connected by a building floor line 6 to a node K6. The node K3 is connected by a building floor line 6 to a node K5.

Two partial sections TS1 and TS2, explicitly characterized as such, are connected across the node K4, TS1 representing a partial section of the building floor line 6 and TS2 representing a circulation conduit.

Moreover, at node K4 there occurs a branching across a single supply line 7 to a tapping point 9. To simplify matters, the single supply lines and tapping points connected to the nodes K2 and K3 are not given reference numbers. Since the circulation system according to the invention is operated in order to carry out the method according to the invention in a state in which no water removal occurs, the nodes which are coordinated with the tapping points are not considered in the following and, accordingly, not given reference numbers in the drawings, except for node K4.

The partial section TS2 is connected to a vertical circulation conduit 10*a*, which empties into the node K5. The node K5 is connected to a circulation conduit 10*a*, which empties into the node K6. The node K6 is connected to a vertical circulation conduit 10*a*, which is connected to a horizontal circulation conduit 10*a*, which in turn is connected across a vertical circulation conduit to the circulation pump 10*b*.

The circulation system represented in FIG. 2 has a similar structure to the system of FIG. 1, but loop lines are provided in the building floor lines 6, and to simplify matters a reference number 8 is used only for the uppermost loop line represented in FIG. 2. The loop line 8 is coordinated with an optional flow divider 8*a*. Loop lines are coordinated with nodes K21 to K32. It is understood that such systems in which only one loop line is present are also covered by the invention.

FIG. 3 shows another system with nodes K31 to K34, but here the circulation conduits 10*a* emptying into the nodes K34 and K35 are led in parallel with the building floor lines 6 departing from the nodes K32 and K33.

Moreover, an optional decentralized cooling device 14 with an input port 14*a* and an output port 14*b* is arranged in the uppermost building floor line 6, while to simplify the representation the existing junctions of a cold-side circuit and a corresponding pump are not shown.

Similarly, further decentralized cooling devices can be arranged in the other building floor lines.

In another embodiment similar to FIG. 3, the heat exchanger 12 may be omitted; in this case, one cooling device 14 or multiple cooling devices 14 are necessary.

Similar to the embodiment of FIG. 3, cooling devices can be provided in the riser pipes 5 and the building floor line of the embodiments of FIGS. 1, 2 and 4 to 8.

Figure 1:
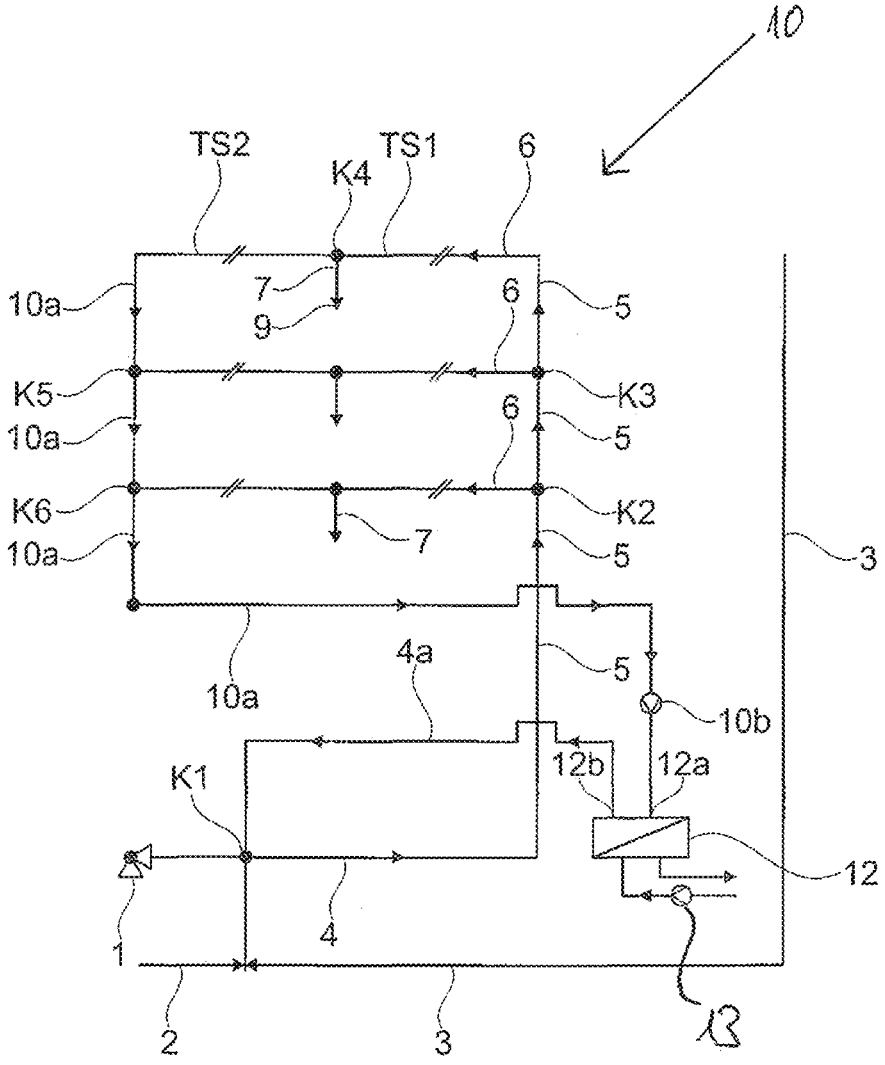
Figure 3:
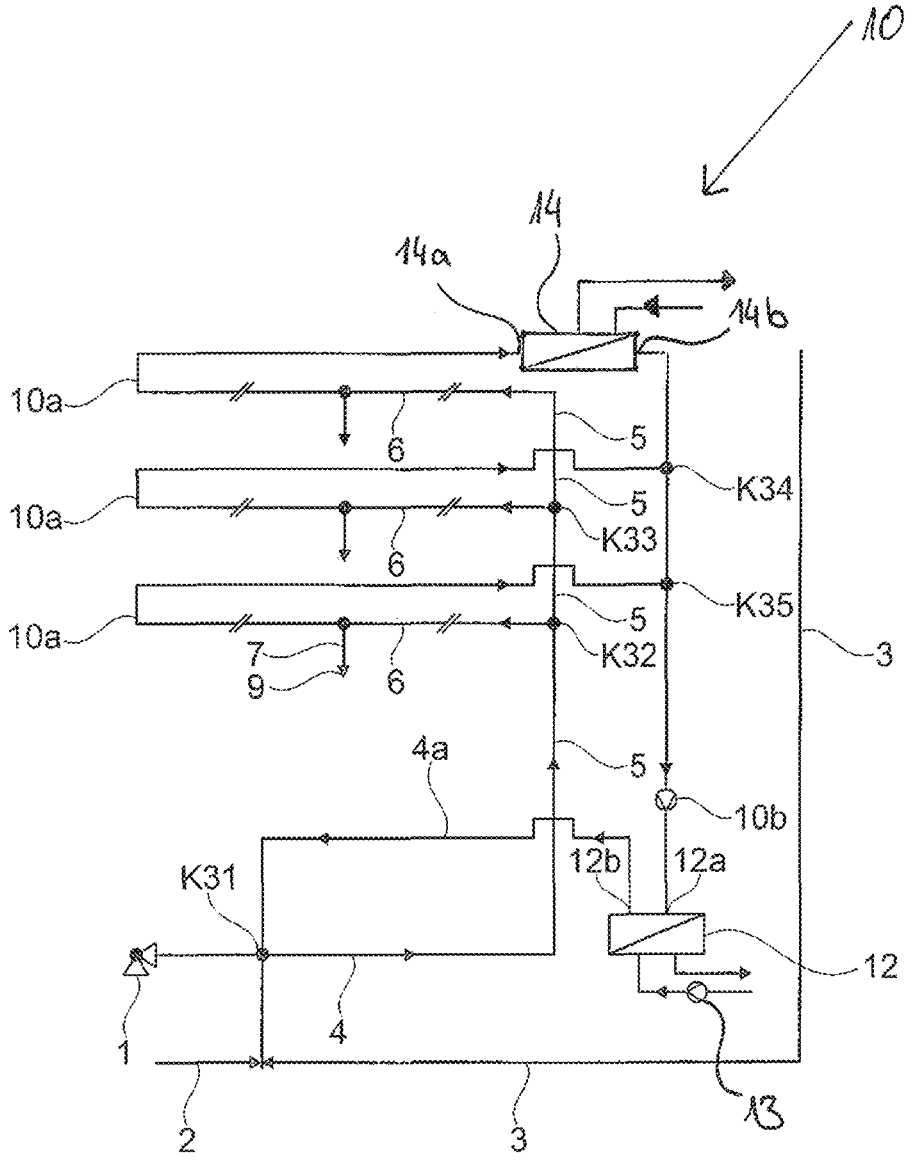
Figure 5:
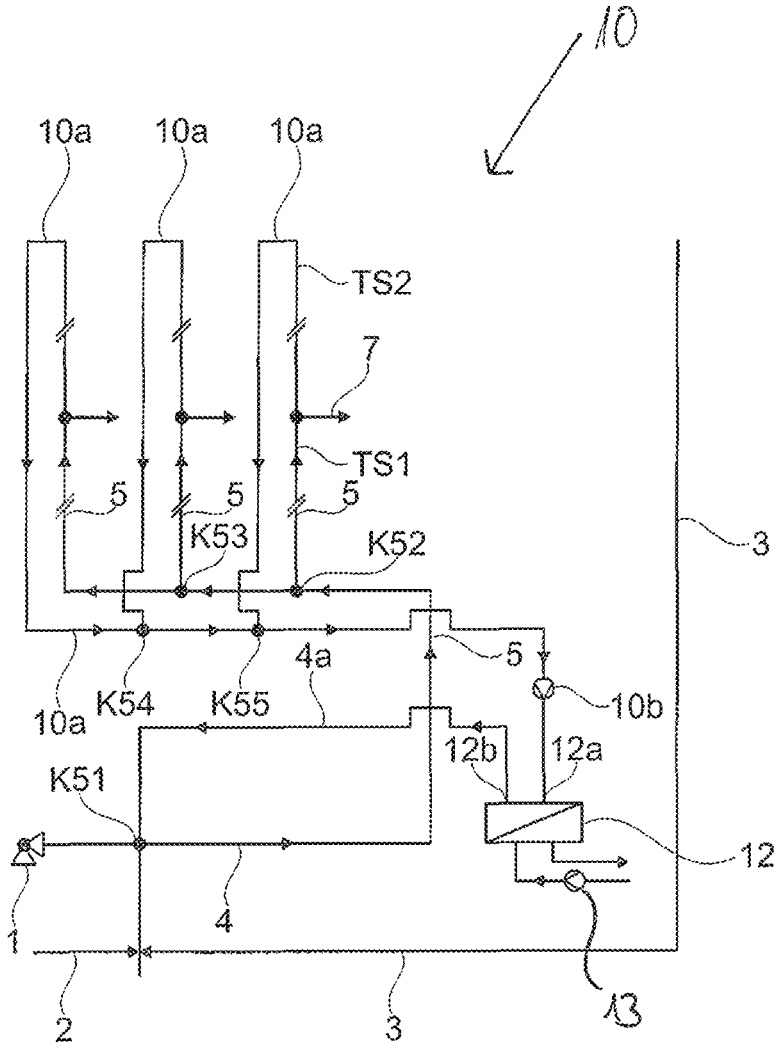
FIG. 5 shows a system with nodes K51 to K55, in which circulation conduits 10 are led in parallel with the riser pipes 5 connected to the nodes K52, K53.
Figure 7:
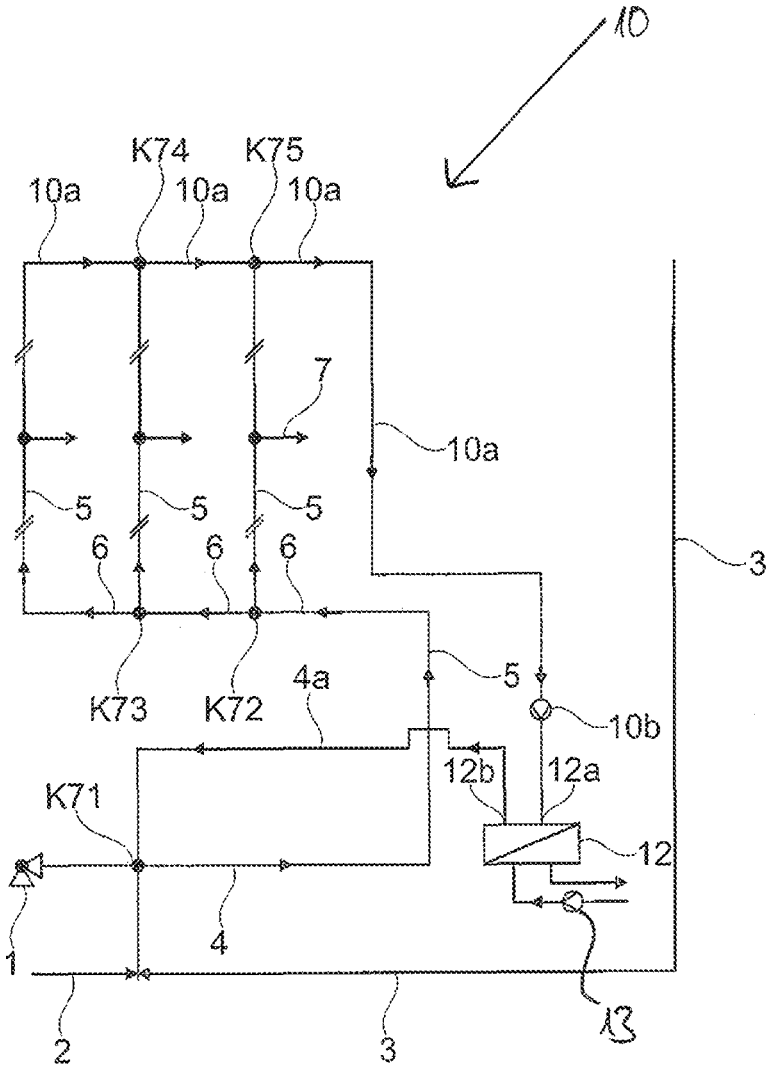
FIG. 7 shows a system with the nodes K71 to K75, where riser pipes 5 are connected to the nodes K72 and K73.

The embodiments represented in the clean drawings under FIGS. 1, 3, 5, 7 can also allow only partial regions to have a circulation. Thus, the partial sections may also represent installations in dwellings, for example, which are not permitted to circulate together on account of different requirements (account metering of the water consumption). A water exchanging to maintain the desired temperature could be possible here with automatic flushing.

Figure 2:
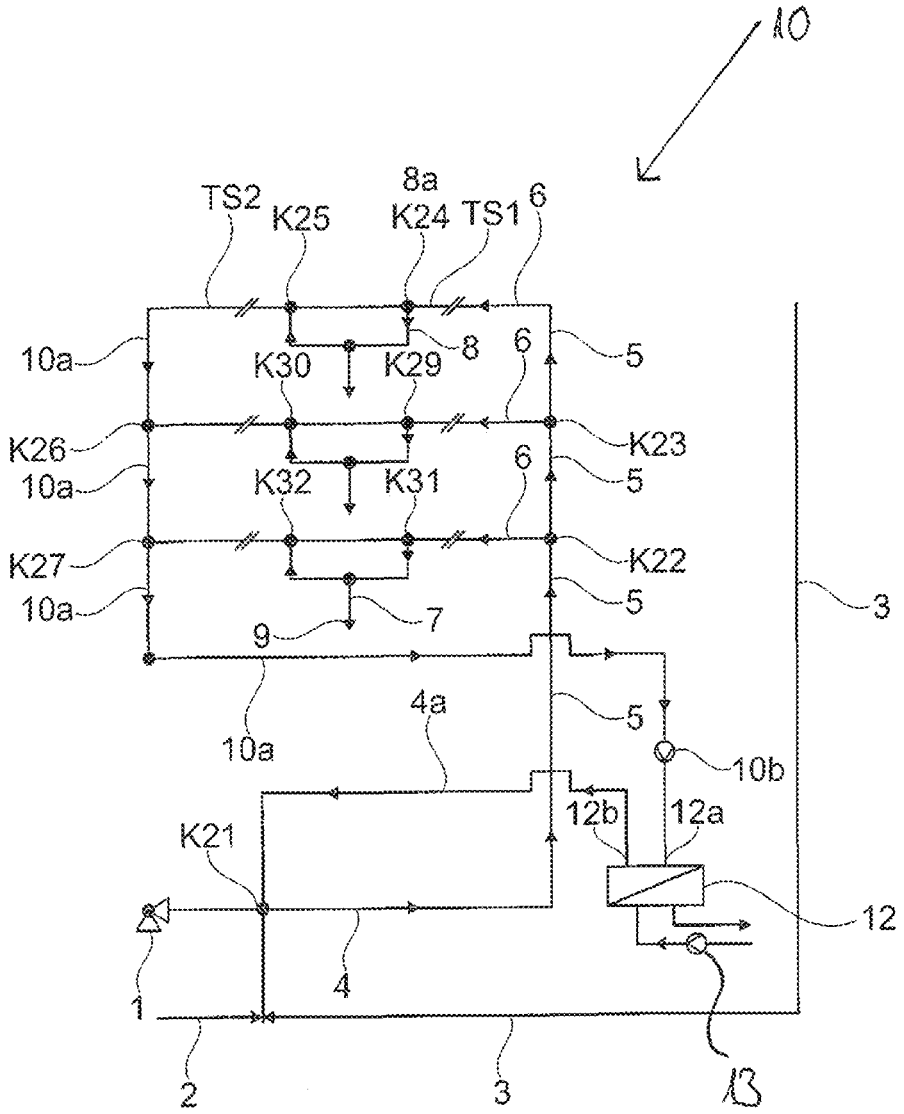
Figure 4:
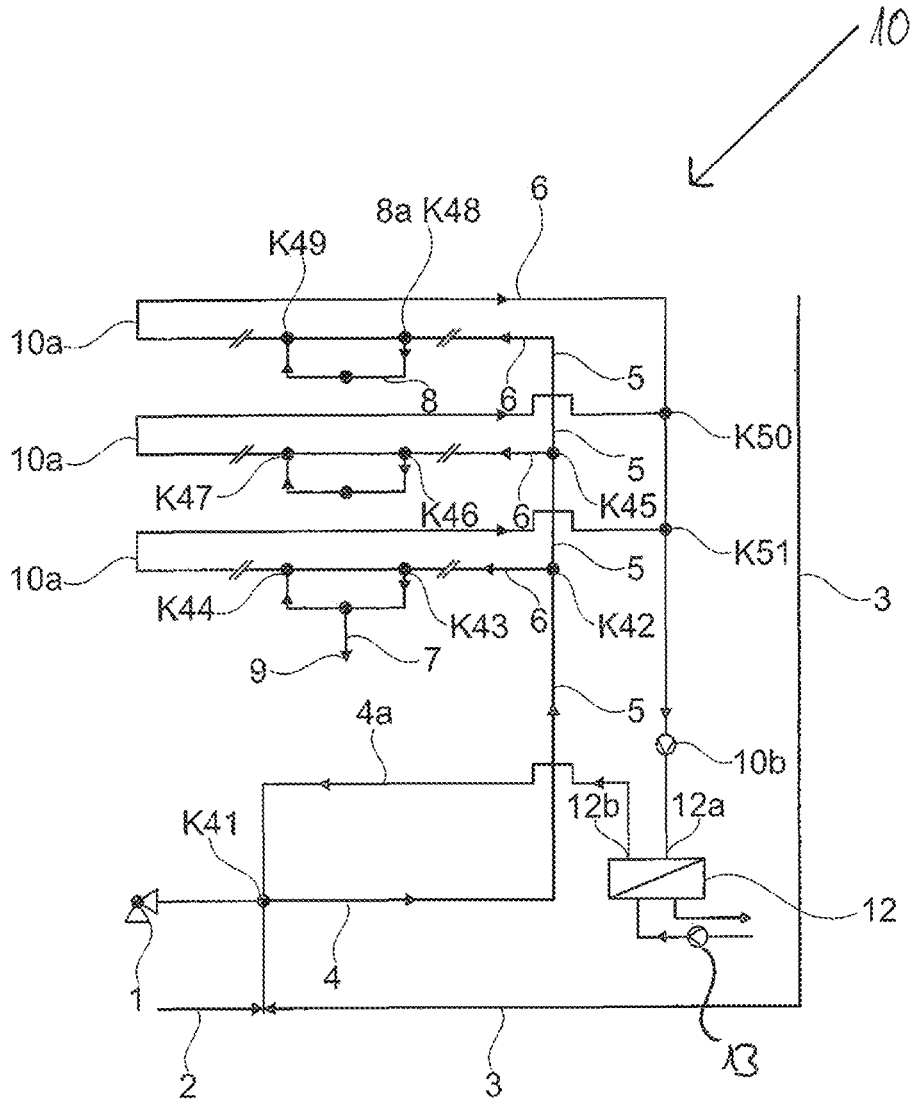
FIG. 4 shows a system with nodes K41 to K51 as in FIG. 3, but loop lines 8 are provided in the building floor lines.
Figure 6:
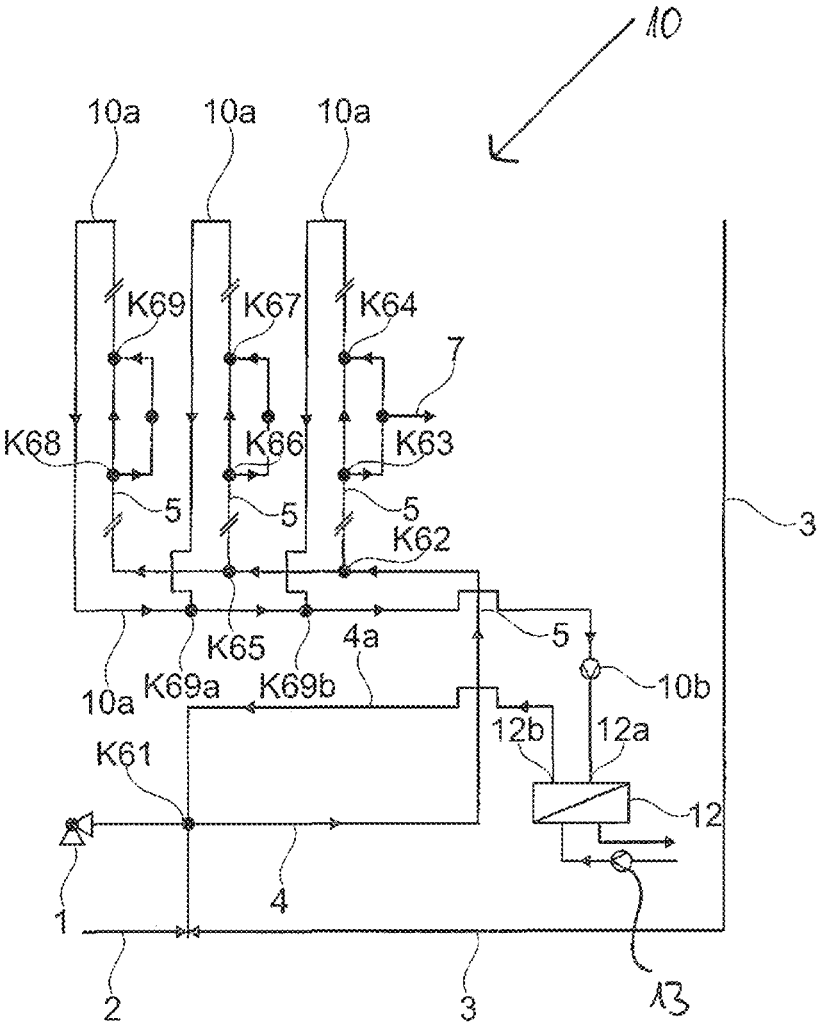
FIG. 6 shows a system with the nodes K61 to K69*b*, where loop lines are provided between the nodes K63, K64, K66, K67 and K68, K69.
Figure 8:
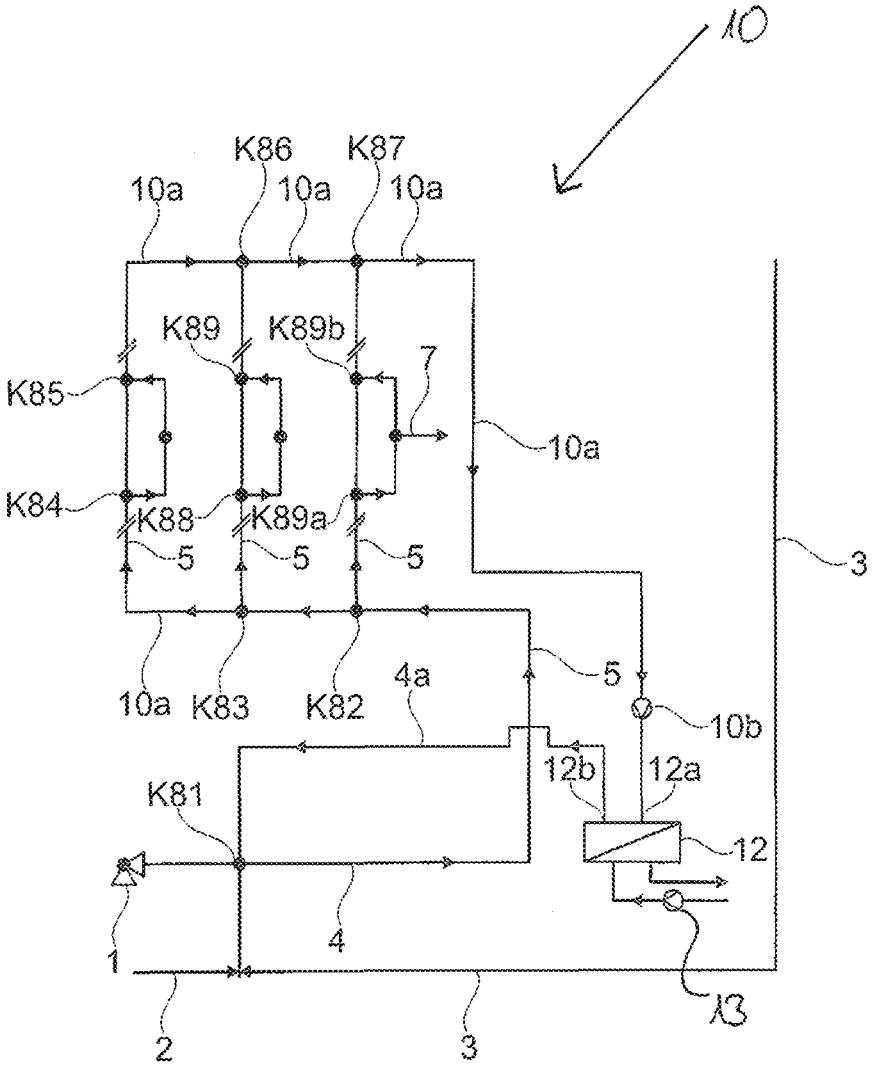
FIG. 8 shows a system with nodes K81 to K89*b* similar to FIG. 7, but with loop lines arranged between the nodes K89*a*, K89*b*, K88, K89 and K84 and K85.

The method according to the invention is implemented in the systems of FIGS. 1 to 8 in the above-described manner: starting from a temperature start value $T_{MA}^*<T_{soll}$ and a volume flow start value $V_z^*$ for the first partial section connected to the output port (12*b*), a temperature change of the water between the initial region and the end region is determined according to a model of the temperature change.

Moreover, a temperature change of the water between the initial region and the end region for each further given partial section is determined according to the model of the temperature change, under the boundary condition that the water temperature in the initial region of the given partial section is equal to the water temperature in the end region of the partial section to which the given partial section is connected.

Preferably, one uses the above-described model of the axial temperature change, according to which the water temperature $T_{ME}$ in the end region of a partial section of length L is calculated by the formula $$T_{ME} = (T_{MA} - T_{Luft}) * e^{-\varepsilon * L} + T_{Luft}$$

$$\varepsilon = \frac{k_R}{m_M * c_{pm}} = \frac{k_R}{V_M * P_M * C_{pm}}$$

The value $T_a$ of the water temperature and the value $V_z$ of the volume flow at the output port 12*b* are chosen such that, in the end region of each partial section of the circulation system, the water temperature is $T_{ME}<T_{soll}$ and at the input port 12*a* the water temperature is $T_b<T_{soll}$ with $T_{soll}-T_b<\theta$, where $\theta>0$ is a predetermined value.

It is understood that the circulation pump 10*b* is not always operated with a constant volume flow, i.e., regardless of whether the port inlet temperature 12*a* has exactly the setpoint value or even lies below it.

If the port inlet temperature 12*a* for various reasons should lie at 17° C. for example, where a max. of 20° C. is given, the delivery volume flow of the circulation pump 10*b* could be reduced. This can be done automatically, for example, under temperature control. As a result, energy savings will be achieved.

Likewise, in such a case the delivery volume flow of the pump 13 can be reduced by temperature control.

If the port inlet temperature for various reasons should lie at 17° C. for example (where a max. of 20° C. is given for example), the flow temperature in the refrigeration circuit could likewise be adjusted. As a result, energy savings would be achieved.

TABLE 1

| Symbol | Unit | Designation | Explanation |
|---|---|---|---|
| $c_w$ | kJ(kg K) | Specific heat capacity of the water | Heat for the heating of 1 kg of water by 1K (4, 19 KJ/(kg K)) |
| ρ | kg/m$^3$ | Density of the water | Quotient of mass and volume of water at given temperature |
| $\alpha_a$ | W(m$^2$ K) | Outward heat transmission coefficient | Heat loss of a 1 m$^2$ surface for a temperature difference between the surface and air of 1K |
| λD | W(m K) | Thermal conductivity of the insulation | |
| λR | W(m K) | Thermal conductivity of the pipeline | |
| λges | W(m K) | Thermal conductivity of a structural piece, here a pipeline incl. multilayered | insulation |
| $\frac{1}{\lambda_{ges}}$ | (m K)W | Thermal resistance | |
| $\frac{1}{U_R}$ | (m K)W | Heat transition resistance | |
| $U_R$ | W(m K) | Heat transfer coefficient for the pipe | Heat loss of a 1 m long insulated hot water pipe at a temperature difference between the water and the air of 1K |
| $d_a$ | mm | Pipe outer diameter | Outer diameter of a hot water line |
| D | mm | Pipe outer diameter | Outer diameter of an insulated hot water line |

TABLE 1-continued

| Symbol | Unit | Designation | Explanation |
|---|---|---|---|
| L | m | Pipeline length | Length of a partial section |
| $\vartheta_{Luft}$ | ° C. | Air/surrounding temperature | |
| $\Delta\vartheta a$ | K | Starting temperature difference | Temperature difference between surroundings and medium at the start of a partial section |
| $\vartheta_{MA}$ | ° C. | Medium temperature at start | Temperature of a medium at the start of a partial section |
| $\vartheta_{ME}$ | ° C. | Medium temperature at end | Temperature of a medium at the end of a partial section |

LIST OF REFERENCE NUMBERS

1 Connection to a water supply network
2 Connection line
3 Consumer line
4 Collective feed line
5 Riser (down pipe)
6 Building floor line
7 Single supply line
8 Loop line
8*a* Static or dynamic flow division
9 Tapping point
10 Circulation system
10*a* Circulation conduit
10*b* Circulation pump
12 Cooling device
12*a* Input port
12*b* Output port
14 Heat exchanger
14*a* Input port
14*b* Output port

The invention claimed is:

1. A method for water temperature management in a circulation system, the circulation system comprising:

a cooling device with an input port and an output port, the cooling device configured to identify the temperature of water at the input port ($T_b$) and produce water at a set temperature value at the output port ($T_a$), the circulation system further comprising a branched pipeline system, the branched pipeline system, in fluid communication with the input port and output port, comprising:

one or more partial sections thermally coupled to a surrounding, wherein the partial sections comprise one or more pipe units, each pipe unit comprises at least one single supply line connected to a tapping point, at least one circulation conduit, and at least one flow pipe, and the at least one flow pipe comprises at least one of a collective feed line, a riser line, and a building floor line, wherein the branched pipeline system is configured to allow a flow of water therethrough at a specified volumetric flow rate of water ($V_z$) at the input port, and a regulator configured to receive values for the temperature of water at the input port ($T_b$) from the cooling device and the specified flow rate of water ($V_z$), the regulator further configured to formulaically determine temperatures associated with the one or more partial sections and operate the cooling device, the method comprising:

specifying, through the regulator, a target temperature ($T_{soll}$) for the temperature of water at the input port;

specifying, through the regulator, a positive preset difference value (0) for the target temperature ($T_{soll}$) minus the identified temperature of water at the input port ($T_b$);

calculating, through the regulator, a temperature of water proximate an end region of each of the one or more partial sections ($T_{ME}$) based on an identified temperature of water at the input port ($T_b$) and flow rate of water ($V_z$);

identifying selection values for the set temperature value at the output port ($T_a$) and flow rate of water ($V_z$) such that the temperature of water proximate an end region ($T_{ME}$) for each partial section is below the target temperature ($T_{soll}$), the identified temperature of water at the input port ($T_b$) is less than the target temperature ($T_{soll}$), and the target temperature ($T_{soll}$) minus the identified temperature of water at the input port ($T_b$) is less than the positive preset difference value ($\theta$); and setting the set temperature value at the output port ($T_a$) to the respective identified selection value therefore through the cooling device;

whereby, water temperatures within the circulation system are managed to be below the target temperature ($T_{soll}$) to inhibit microbial growth in the circulation system and comply with relevant guidelines concerning water temperatures in the circulation system.

2. The method according to claim 1, wherein the one or more partial sections comprises two or more partial sections, including at least a first partial section in fluid communication with the output port of the cooling device and a last partial section in fluid communication with the input port of the cooling device, and the end region of each partial section is proximate and in fluid communication with one of an initial region of a particular additional partial section or the input port of the cooling device, wherein the temperature of water proximate an end region ($T_{ME}$) for the first partial section is calculated utilizing a temperature start value ($T_{MA}$*) and wherein the temperature of water proximate an end region ($T_{ME}$) for each particular additional partial section is calculated utilizing the temperature of water proximate an end region ($T_{ME}$) for the partial section having an end region proximate and in fluid communication with the initial region the particular additional partial section.

3. The method according to claim 1, wherein each partial section has a length (L) and the temperature of water proximate an end region ($T_{ME}$) for each partial section is calculated from a formula:

$$T_{ME} = (T_{MA} - T_{Luft}) * e^{-\varepsilon * L} + T_{Luft}$$

$$\varepsilon = \frac{k_R}{m_M * c_{pm}} = \frac{k_R}{V_M * P_M * C_{pm}}$$

where

L=the length of the uniform partial section ($T_{S1}$) (m)

$T_{MA}$=the water temperature in the initial region (° C.)

$T_{ME}$=the water temperature in the end region (° C.)

$T_{Luft}$=the temperature of the ambient air (° C.)

$k_R$=the heat transfer coefficient of the pipeline (W/(m*K))

$m_M$=the mass flow of the water in the partial section (kg/s)

$c_{p,m}$=the spec heat capacity of the water (J/(kg*K)

$V_M$=the volume flow of the water in the partial section ($m^3$/s)

$p_M$=the density of the water (kg/$m^3$).

4. The method according to claim 3, where the heat transfer coefficient ($k_R$) of the partial sections is calculated from formulas:

$$\frac{1}{k_R} = \frac{1}{d_i * \alpha_i * \pi} + \frac{1}{\Lambda_R} + \frac{1}{d_a * \alpha_a * \pi}$$

where $1/k_R$=the heat transmission resistance of the pipeline ($m^2$*K/W)

αi=the inward heat transfer coefficient (W/($m^2$*K))

1/Λ=the thermal resistance (m*K/W) ΔR $a_a$=the outward heat transfer coefficient (W/($m^2$*K))

$d_a$=the outer diameter (m)

$d_i$=the inner diameter (m)

and $$\frac{1}{\Lambda_R} = \frac{1}{2 * \pi} * \left(\frac{1}{\lambda_r} * \ln\frac{d_{aR}}{d_{iR}} + \frac{1}{\lambda_D} * \ln\frac{d_{aD}}{d_{iD}}\right).$$

5. The method according to claim 1, wherein the cooling device is thermally coupled, though a heat transfer agent, to a material flow configured to accept thermal energy from water in the cooling device thereby producing water at the set temperature value at the output port ($T_a$).

6. The method according to claim 5, characterized in that the cooling device is thermally coupled to and the material flow is produced within a cold generator, preferably a heat pump, a water chiller or a cold supply network.

7. The method according to claim 1, further comprising:

identifying power consumption of the cooling device in dependence on a water temperature at the output port through at least one consumer characteristic thereof, wherein identified selection value for the set temperature value at the output port ($T_a$) is set such that the power consumption of the cooling device takes on a relative or absolute minimum value.

8. A method for determining and applying values of configurable parameters for a cooling device in a circulation system to maintain water temperature in a portion of the system below a predetermined threshold ($T_{soll}$), the circulation system comprising a cooling device with an input port and an output port and having a branched pipeline system comprising one or more partial sections with given thermal coupling to a surrounding, the partial sections being connected through nodes, wherein one or more lines of the pipeline system are configured as a flow pipe, at least one of the lines is configured as a single supply line connected to a tapping point, and at least one of the lines is configured as a circulation conduit connected to the flow pipe or pipes, the method comprising:

calculating a first temperature change of water between an initial region and end region of a first partial section, the initial region of the first partial section connected and in fluid communication with the output port and the temperature change in the first partial section calculated formulaically based on a volumetric flow rate of water ($V_z$) and temperature start value ($T_{MA}$*), wherein the temperature start value ($T_{MA}$*) is below the predetermined threshold ($T_{soll}$);

calculating additional temperature changes of water between an initial region and end region of additional partial sections with an initial region thereof proximate and in fluid communication with an end region of one of the first partial section or another partial section of the additional partial sections, the temperature change in the particular one of the additional partial sections based on a temperature at the end region ($T_{ME}$) affixed to the initial region of the particular one of the additional partial sections and the flow rate of water ($V_z$);

identifying selection values for a set temperature value at the output port ($T_a$) and the flow rate of water ($V_z$) such that the temperature at the end region ($T_{ME}$) for the first partial section and additional partial sections are below the predetermined threshold ($T_{soll}$), the temperature at the inlet port ($T_b$) is less than the predetermined threshold ($T_{soll}$), and the predetermined threshold ($T_{soll}$) minus the temperature at the inlet port ($T_b$) is less than a positive preset difference value (θ); and setting the set temperature value at the output port ($T_a$) for the output port to the respective identified selection value therefore through the cooling device;

whereby, values of configurable parameters for a cooling device in a circulation system are determined to maintain water temperatures within portions of the circulation system below the predetermined threshold ($T_{soll}$) to inhibit microbial growth in the circulation system and comply with relevant guidelines concerning water temperatures in the circulation system.

* * * * *